US009685118B2

(12) United States Patent
Cho et al.

(10) Patent No.: US 9,685,118 B2
(45) Date of Patent: Jun. 20, 2017

(54) ORGANIC LIGHT-EMITTING DISPLAY DEVICE AND METHOD OF DRIVING THE SAME

(71) Applicant: SAMSUNG DISPLAY CO., LTD., Yongin, Gyeonggi-Do (KR)

(72) Inventors: Young Jin Cho, Seoul (KR); Young In Hwang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 68 days.

(21) Appl. No.: 14/703,766

(22) Filed: May 4, 2015

(65) Prior Publication Data

US 2016/0148571 A1 May 26, 2016

(30) Foreign Application Priority Data

Nov. 24, 2014 (KR) ..... 10-2014-0164529

(51) Int. Cl.
*G09G 3/3258* (2016.01)
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2310/0262* (2013.01); *G09G 2310/08* (2013.01); *G09G 2320/043* (2013.01)

(58) Field of Classification Search
CPC ..... G09G 2310/0262; G09G 2310/08; G09G 2320/043; G09G 3/3225; G09G 3/3266
USPC ..... 345/212, 419
See application file for complete search history.

(56) References Cited

U.S. PATENT DOCUMENTS

2012/0146999 A1* 6/2012 Hwang ..... G09G 3/003 345/419
2013/0021228 A1 1/2013 Miwa et al.
2014/0320476 A1* 10/2014 Choi ..... G09G 3/3258 345/212

FOREIGN PATENT DOCUMENTS

KR 10-2012-0009904 A 2/2012
KR 10-2012-0048294 A 5/2012
KR 10-2012-0114245 A 10/2012
KR 10-2014-0030479 A 3/2014

* cited by examiner

*Primary Examiner* — Tony Davis
(74) *Attorney, Agent, or Firm* — Lewis Roca Rothgerber Christie LLP

(57) ABSTRACT

An organic light-emitting display device includes a data line, a scan line, and a display panel including a pixel where the data line crosses the scan line. The pixel includes: a switching transistor including a gate electrode connected to the scan line and a first electrode connected to the data line; a first capacitor between a second electrode of the switching transistor and a reference voltage source; a second capacitor including a first terminal connected to the first electrode of the switching transistor via a first node and a second terminal connected to a second node; a driving transistor including a first electrode connected to a first power source via the second node, a second electrode connected to an organic light-emitting diode, and a gate electrode connected to the reference voltage source via a third node; and a third capacitor between the second and third nodes.

20 Claims, 10 Drawing Sheets

ORGANIC LIGHT-EMITTING DISPLAY DEVICE AND METHOD OF DRIVING THE SAME

CROSS-REFERENCE TO RELATED APPLICATION

This application claims priority to and the benefit of Korean Patent Application No. 10-2014-0164529, filed on Nov. 24, 2014 in the Korean Intellectual Property Office, the entire content of which is incorporated herein by reference.

BACKGROUND

1. Field

Aspects of embodiments of the present invention relate to an organic light-emitting display device and a method of driving the same.

2. Description of the Related Art

Organic light-emitting display devices have been increasingly highlighted as next-generation display devices, and display images by using organic light-emitting diodes (OLEDs), which generate light through the recombination of electrons and holes. Organic light-emitting display devices provide various benefits, such as fast response speed, high luminance, wide viewing angles, and low power consumption.

More specifically, organic light-emitting display devices use driving transistors included in corresponding pixels to control the amount of current provided to the respective OLEDs, and each of the OLEDs generates light with a set or predetermined luminance based on the amount of current provided thereto. However, when the driving transistors of the pixels are driven with the same voltages, the amount of driving current provided to each of the corresponding OLEDs may vary due to differences between the threshold voltages of the driving transistors. As a result, the OLEDs may not be able to produce the same luminance even in response to the same data voltages.

SUMMARY

Embodiments of the present invention provide for an organic light-emitting display device capable of compensating for the threshold voltage of a driving transistor of a pixel by using a source follower configuration. Embodiments of the present invention also provide for a method of driving an organic light-emitting display device capable of compensating for the threshold voltage of a driving transistor of a pixel by using a source follower configuration. However, embodiments of the present invention are not restricted to those set forth herein. The above and other embodiments of the present invention will become more apparent to one of ordinary skill in the art to which the invention pertains by referencing the detailed description of the invention given below.

According to an embodiment of the present invention, an organic light-emitting display device is provided. The organic light-emitting display device includes a data driver configured to provide a data signal to a data line, a scan driver configured to provide a scan signal to a scan line, and a display panel including at least one pixel at a crossing region of the data line and the scan line. The at least one pixel includes: a switching transistor including a gate electrode connected to the scan line and a first electrode connected to the data line; a first capacitor including a first terminal connected to a second electrode of the switching transistor and a second terminal connected to a reference voltage source; a second capacitor including a first terminal connected to the first electrode of the switching transistor via a first node and a second terminal connected to a second node; a driving transistor including a first electrode connected to a first power source via the second node, a second electrode connected to an organic light-emitting diode (OLED), and a gate electrode connected to the reference voltage source via a third node; and a third capacitor including a first terminal connected to the second node and a second terminal connected to the third node.

The at least one pixel may further include a first transistor including a first electrode connected to the second electrode of the switching transistor and a second electrode connected to the first node, a second transistor including a first electrode connected to the reference voltage source and a second electrode connected to the first node, a switching unit connected between the reference voltage source and the third node, a third transistor including a first electrode connected to the first power source and a second electrode connected to the second node, a fourth transistor including a first electrode connected to the second electrode of the driving transistor and a second electrode connected to the OLED, and a fifth transistor including a first electrode connected to the first electrode of the fourth transistor and a second electrode connected to a gate electrode of the fifth transistor.

The switching unit may include sixth and seventh transistors, each constituting a separate path between the reference voltage source and the third node.

The second, fifth and sixth transistors may be configured to turn on during a first period of a compensation period, the first and seventh transistors may be configured to turn on during a second period of the compensation period, which follows the first period, and the third and fourth transistors may be configured to turn on during an emission period, which follows the second period.

The switching unit may include an eighth transistor including a first electrode connected to the reference voltage source and a second electrode connected to the third node.

The driving transistor may be configured to control a driving current flowing through the OLED by using a data voltage that depends on a voltage charged in each of the first through third capacitors as well as a voltage provided by the first power source via the second node.

According to another embodiment of the present invention, an organic light-emitting display device is provided. The organic light-emitting display device includes a data driver configured to provide a data signal to a data line, a scan driver configured to provide a scan signal to a scan line, and a display panel including at least one pixel at a crossing region of the data line and the scan line. The at least one pixel includes: a data voltage providing unit configured to charge a first capacitor with a data voltage provided via the data line and apply the data voltage that the first capacitor is charged with to a first node via a switching operation; a second capacitor including a first terminal connected to the first node and a second terminal connected to a second node; a driving transistor configured to control a driving current flowing through an organic light-emitting diode (OLED) according to a voltage applied to the second node and a voltage applied to a third node that is connected to a gate electrode of the driving transistor; a reference voltage providing unit configured to apply a reference voltage to the third node; a third capacitor including a first terminal connected to the second node and a second terminal connected to the third node, and configured to be charged with the reference voltage; a first switching unit configured to connect or block a path between a first power source and the second node; and a second switching unit configured to connect or block a path between a second electrode of the driving transistor and the OLED.

The data voltage providing unit may include a switching transistor including a first electrode connected to the data line and a gate electrode connected to the scan line, a first transistor including a first electrode connected to a second electrode of the switching transistor and a second electrode connected to the first node, and a second transistor including a first electrode connected to a second terminal of the first capacitor and a second electrode connected to the first node.

The first switching unit may include a third transistor including a first electrode connected to the first power source and a second electrode connected to the second node.

The second switching unit may include a fourth transistor including a first electrode connected to the second electrode of the driving transistor and a second electrode connected to the OLED, and a fifth transistor including a first electrode connected to the first electrode of the fourth transistor and a second electrode connected to a gate electrode of the fifth transistor.

The reference voltage providing unit may include sixth and seventh transistors, each constituting a separate path between a source of the reference voltage and the third node.

The reference voltage providing unit may include an eighth transistor including a first electrode connected to a source of the reference voltage and a second electrode connected to the third node.

The driving transistor may be configured to control the driving current flowing through the OLED by using a data voltage that depends on a voltage charged in each of the first through third capacitors as well as a voltage provided by the first power source via the second node.

The data voltage providing unit may be configured to apply the reference voltage to the first node during a first period of a compensation period and apply the data voltage to the first node during a second period of the compensation period, which follows the first period, and the reference voltage providing unit may be configured to apply the reference voltage to the third node during the first and second periods.

The first switching unit may be configured to block a path between the first power source and the second node during the first and second periods and to connect the path between the first power source and the second node during an emission period, which follows the second period, and the second switching unit may be configured to block a path between the second electrode of the driving transistor and the OLED during the first and second periods and to connect the path between the second electrode of the driving transistor and the OLED during the emission period.

According to yet another embodiment of the present invention, a method of driving an organic light-emitting display device is provided. The organic light-emitting display device includes at least one pixel. The at least one pixel includes a driving transistor connected between a first power source and a second power source and configured to control a driving current flowing through an OLED, a switching transistor connected to a data line, and a first capacitor connected between the switching transistor and a reference voltage source. The method includes applying a reference voltage provided by the reference voltage source to a first node and a gate electrode of the driving transistor during a first period of a compensation period, applying a data voltage that the first capacitor is charged with to a first electrode of the driving transistor through a switching operation during a second period of the compensation period that follows the first period, and applying the data voltage to the gate electrode of the driving transistor by connecting a path between the first power source and the second power source during an emission period.

The at least one pixel may include a first switching unit configured to connect or block a path between the first power source and a second node, and a second switching unit configured to connect or block a path between a second electrode of the driving transistor and the OLED.

During the first and second periods, the first switching unit may be configured to block the path between the first power source and the second node, and the second switching unit may be configured to block the path between the second electrode of the driving transistor and the OLED. During the emission period, the first switching unit may be configured to connect the path between the first power source and the second node, and the second switching unit may be configured to connect the path between the second electrode of the driving transistor and the OLED.

The at least one pixel may further include a second capacitor including a first terminal connected to the first node and a second terminal connected to the first electrode of the driving transistor, and a third capacitor including a first terminal connected to the first electrode of the driving transistor and a second terminal connected to the gate electrode of the driving transistor.

The data voltage may depend on a voltage charged in each of the first through third capacitors as well as a driving voltage provided by the first power source. The driving transistor may be configured to control the driving current flowing through the OLED according to the data voltage.

According to embodiments of the present invention, the threshold voltage of a driving transistor of a pixel of an organic light-emitting display device is compensated for by using a source follower configuration, and can thus be prevented from affecting long-range uniformity (LRU). In addition, even when the threshold voltage of the driving transistor varies from one pixel to another pixel, any luminance irregularities between the pixels can be addressed by compensating for the threshold voltage of the driving transistor. Other features and embodiments will be apparent from the following detailed description, the drawings, and the claims.

BRIEF DESCRIPTION OF THE DRAWINGS

The above and other features and aspects of the present invention will become more apparent by describing in detail embodiments thereof with reference to the attached drawings.

DETAILED DESCRIPTION

Figure 1:
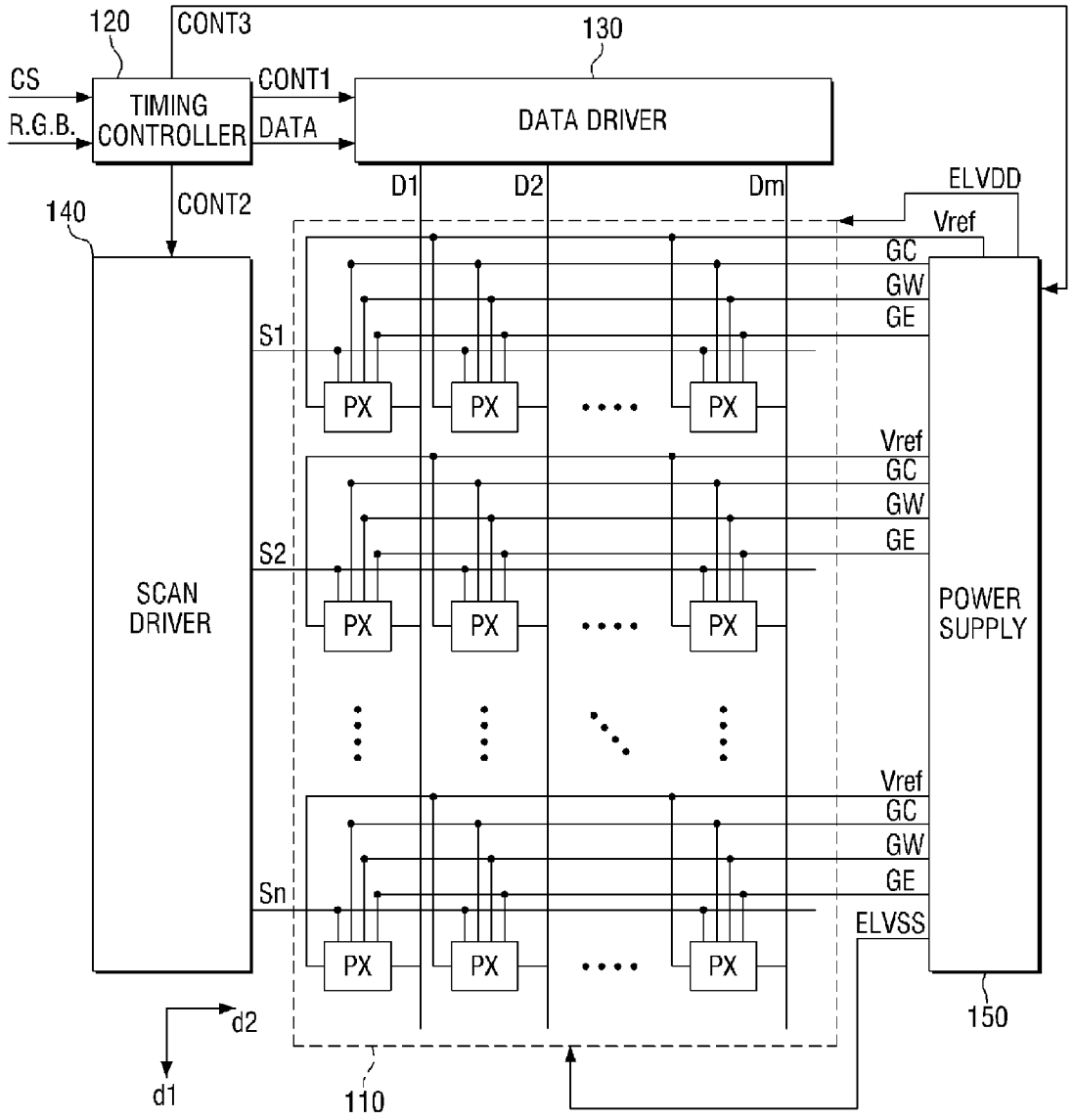
FIG. 1 is a block diagram of an organic light-emitting display device according to an embodiment of the present invention.

Aspects and features of the present invention and methods of accomplishing the same may be understood more readily by reference to the following detailed description of example embodiments and the accompanying drawings. The present invention may, however, be embodied in many different forms and should not be construed as being limited to the embodiments set forth herein. Rather, these embodiments are provided so that this disclosure will more fully convey concepts of the present invention to those skilled in the art, as defined by the appended claims. Similar or like reference numerals refer to similar or like elements throughout the specification.

The terminology used herein is for describing particular embodiments only and is not intended to be limiting of the present invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to", or "coupled to" another element or layer, it can be directly on, connected, or coupled to the other element or layer, or intervening elements or layers may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc., may be used herein to describe various elements, components, regions, layers, and/or sections, these elements, components, regions, layers, and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" in reference to one figure can encompass an orientation of above in reference to another figure. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include deviations in shapes that result, for example, from manufacturing.

For example, an implanted region illustrated as a rectangle may, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature, and their shapes are not intended to precisely illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed. Hereinafter, embodiments of the present invention will be described with reference to the accompanying drawings.

FIG. 1 is a block diagram of an organic light-emitting display device according to an embodiment of the present invention.

Referring to FIG. 1, the organic light-emitting display device may include a display panel 110, a timing controller 120, a data driver 130, a scan driver 140, and a power supply 150. The display panel 110 may be a region where an image is displayed. The display panel 110 may include a plurality of data lines D1 through Dm (where m is a natural number greater than 1) and a plurality of scan lines S1 through Sn (where n is a natural number greater than 1) that cross the data lines D1 through Dm. The display panel 110 may also include a plurality of pixels PX that are provided at the crossing regions between the data lines D1 through Dm and the scan lines S1 through Sn.

The data lines D1 through Dm, the scan lines S1 through Sn, and the pixels PX may be disposed on a single substrate, and the data lines D1 through Dm and the scan lines S1 through Sn may be insulated from one another. The data lines D1 through Dm may extend in a first direction d1, and the scan lines S1 through Sn may extend in a second direction d2 that crosses the first direction d1. In the embodiment of FIG. 1, the first direction d1 may be a column direction, and the second direction d2 may be a row direction.

The pixels PX may be arranged in a matrix form. Each of the pixels PX may be connected to one of the data lines D1 through Dm and one of the scan lines S1 through Sn. Each of the pixels PX may be provided with a scan signal via one of the scan lines S1 through Sn connected thereto, and may be provided with a data signal via one of the data lines D1 through Dm connected thereto. The pixels PX may be connected to a first power source ELVDD via a first power line, and may be connected to a second power source ELVSS via a second power line. Each of the pixels PX may control the amount of current flowing from the first power source ELVDD to the second power source ELVSS according to the data signal provided thereto via one of the data lines D1 through Dm connected thereto.

The timing controller 120 may receive a control signal CS and image signals R, G, B from an external system. The control signal CS may include a vertical synchronization signal Vsync and a horizontal synchronization signal Hsync. The image signals R, G, B may include luminance information relating to the pixels PX. Luminance may have, for example, 1024, 256, or 64 gray levels. The timing controller 120 may generate image data (shortened to DATA in FIG. 1) by dividing the image signals R, G, B in units of frames according to the vertical synchronization signal Vsync and dividing the image signals R, G, B in units of the scan lines S1 through Sn according to the horizontal synchronization signal Hsync.

The timing controller 120 may provide a data control signal CONT1, a scan control signal CONT2, and a power control signal CONT3 to the data driver 130, the scan driver 140, and the power supply 150, respectively, based on the control signal CS and the image signals R, G, B. More specifically, the timing controller 120 may provide the image data to the data driver 130 together with the data control signal CONT1, and the data driver 130 may convert the image data into corresponding analog voltages through sampling and holding according to the control signal provided thereto by the timing controller 120, thereby generating a plurality of data signals. The data driver 130 may provide the data signals to respective ones of the data lines D1 through Dm.

The data driver 130 may be connected to the display panel 110 via the data lines D1 through Dm. The data driver 130 may provide the data signals to the data lines D1 through Dm under the control of the timing controller 120. More specifically, the data driver 130 may provide a data signal to one or more pixels PX selected by a scan signal. Each of the pixels PX may be turned on by a low-level scan signal, and may emit light according to a data signal provided thereto by the data driver 130, thereby displaying an image.

The scan driver 140 may be connected to the display panel 110 via the scan lines S1 through Sn. The scan driver 140 may sequentially apply a plurality of scan signals to respective ones of the scan lines S1 through Sn according to the scan control signal CONT2, which is provided by the timing controller 120.

The power supply 150 may determine the levels of the first power source ELVDD and the second power source ELVSS according to the power control signal CONT3, which is provided by the timing controller 120, and may supply power to a plurality of power lines connected to the pixels PX. The first power source ELVDD and the second power source ELVSS may provide a driving current to each of the pixels PX. The power supply 150 may also provide a reference voltage Vref to the pixels PX via the power lines connected to the pixels PX.

In addition, the power supply 150 may provide first, second, and third control signals GC, GW, and GE, via their respective power lines, to each of the pixels PX. In the embodiment of FIG. 1, the power supply 150 may provide the first, second, and third control signals GC, GW, and GE to each of the pixels PX, but the present invention is not limited thereto. In other embodiments, an additional integrated circuit (IC) may be supplied to provide the first, second, and third control signals GC, GW, and GE to each of the pixels PX.

Figure 2:
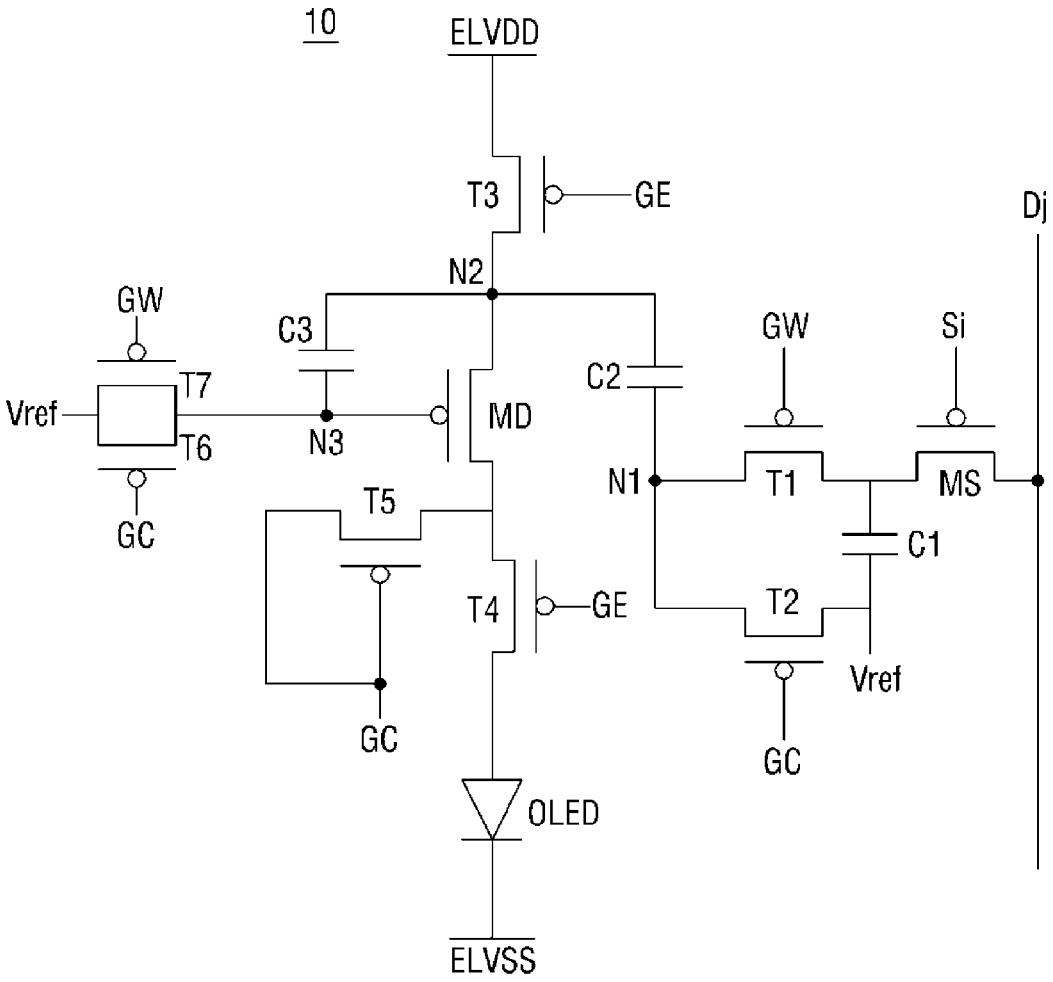
FIG. 2 is a circuit diagram of an example of a pixel of the organic light-emitting display device of FIG. 1.

FIG. 2 is a circuit diagram of an example of a pixel PX of the organic light-emitting display device of FIG. 1. FIG. 2 illustrates the pixel PX connected to an i-th scan line Si and a j-th data line Dj as an example of one of the pixels PX of FIG. 1. For convenience, the pixel PX connected to the i-th scan line Si and the j-th data line Dj will hereinafter be referred to as the pixel 10.

Referring to FIG. 2, the pixel 10 may include a switching transistor MS, a driving transistor MD, an organic light-emitting diode (OLED), and first through third capacitors C1 through C3. The pixel 10 may also include first through fifth transistors T1 through T5 and a switching unit having, for example, sixth and seventh transistors T6 and T7.

The switching transistor MS may include a gate electrode that is connected to the i-th scan line Si and receives a scan signal from the i-th scan line Si, a first electrode that is connected to the j-th data line Dj and receives a data signal from the j-th data line Dj, and a second electrode that is connected to a first terminal of the first capacitor C1. The switching transistor MS may be turned on by the scan signal provided to the gate electrode thereof via the i-th scan line Si, and may transmit a j-th data voltage Vdata provided thereto via the j-th data line Dj to the first capacitor C1.

The driving transistor MD may include a gate electrode that is connected to a third node N3, a first electrode that is connected to a second node N2, and a second electrode that is connected to the second power source ELVSS via the OLED. The driving transistor MD may control a driving current applied from the first power source ELVDD to the OLED according to a voltage applied to the third node N3.

The OLED may include an anode electrode that is connected to a second electrode of the fourth transistor T4, a cathode electrode that is connected to the second power source ELVSS, and an organic light-emitting layer. The organic light-emitting layer may emit light of one of a plurality of primary colors, and the primary colors may include red, green, and blue. A desired color may be displayed by a spatial or temporal sum of the primary colors. The organic light-emitting layer may include a low- or high-molecular organic material corresponding to each color. The organic material included in the organic light-emitting layer may emit light corresponding to each color according to the amount of current flowing through the organic light-emitting layer.

The first capacitor C1 may include a first terminal that is connected to the second electrode of the switching transistor MS, and a second terminal that is connected to a reference voltage source Vref. The first capacitor C1 may be charged with the j-th data voltage Vdata, which is provided via the j-th data line Dj, by a switching operation performed by the switching transistor MS. The second capacitor C2 may include a first terminal that is connected to a first node N1, and a second terminal that is connected to the second node N2. The second capacitor C2 may be charged with a threshold voltage Vth of the driving transistor MD. The third capacitor C3 may include a first terminal that is connected to the second node N2, and a second terminal that is connected to the third node N3.

The first transistor T1 may include a gate electrode that is provided with the second control signal GW, a first electrode that is connected to the second electrode of the switching transistor MS, and a second electrode that is connected to the first node N1. The second transistor T2 may include a gate electrode that is provided with the first control signal GC, a first electrode that is connected to the reference voltage source Vref, and a second electrode that is connected to the first node N1.

The third transistor T3 may include a gate electrode that is provided with the third control signal GE, a first electrode that is connected to the first power source ELVDD, and a second electrode that is connected to the second node N2. The fourth transistor T4 may include a gate electrode that is provided with the third control signal GE, a first electrode that is connected to the second electrode of the driving transistor MD, and a second electrode that is connected to the OLED. The fifth transistor T5 may include a gate electrode that is provided with the first control signal GC, a first electrode that is connected to the second electrode of the driving transistor MD, and a second electrode that is connected to the gate electrode of the fifth transistor T5.

The switching unit may include the sixth and seventh transistors T6 and T7, which provide a two-way path (e.g., two separate paths) between the reference voltage source Vref and the third node N3. The sixth transistor T6 may include a gate electrode that is provided with the first control signal GC, and the seventh transistor T7 may include a gate electrode that is provided with the second control signal GW. In another embodiment, the switching unit may include an eighth transistor T8 in place of the sixth and seventh transistors T6 and T7, which will be described later in detail with reference to FIG. 7.

In an embodiment, the first through eighth transistors T1 through T8 may be p-channel field effect transistors (FETs). In this embodiment, each of the first through eighth transistors T1 through T8 may be turned off by a high-level control signal, and may be turned on by a low-level control signal. The first control signal GC may be applied to the gate electrodes of the second, fifth, and sixth transistors T2, T5, and T6. The second control signal GW may be applied to the gate electrodes of the first and seventh transistors T1 and T7. The third control signal GE may be applied to the gate electrodes of the third and fourth transistors T3 and T4. The first through seventh transistors T1 through T7 may be turned on in response to a low-level control signal being applied to the gate electrodes thereof.

A high-level voltage may be provided by the first power source ELVDD, and a low-level voltage may be provided by the second power source ELVSS. Each of the first power source ELVDD and the second power source ELVSS may provide a driving voltage for driving the pixel 10. For convenience, both the first power source and the voltage provided by the first power source will hereinafter be referred to by ELVDD, both the second power source and the voltage provided by the second power source will hereinafter be referred to by ELVSS, and both the reference voltage and the reference voltage source providing the reference voltage will hereinafter be referred to by Vref.

Figure 3:
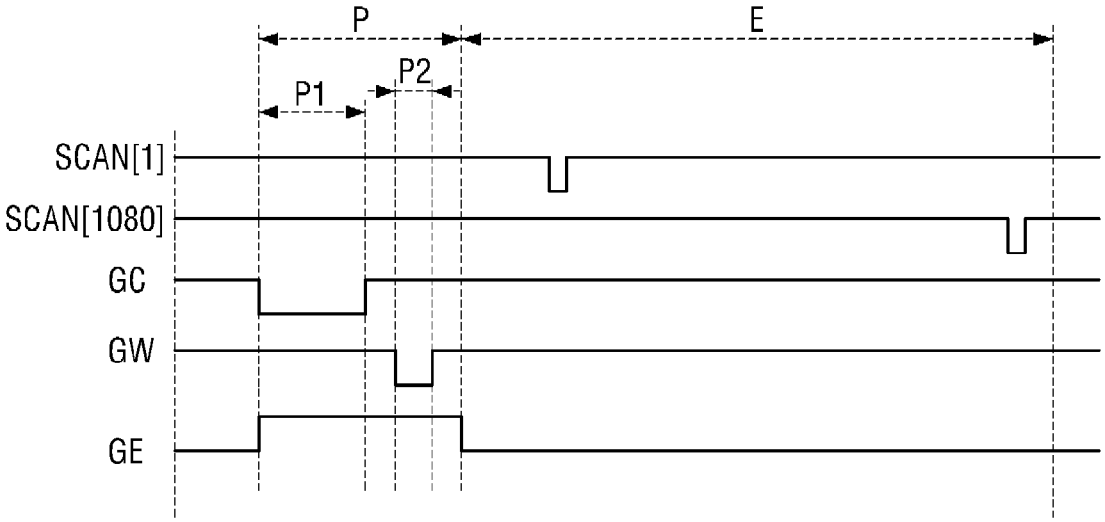
FIG. 3 is a timing diagram illustrating a method of driving an organic light-emitting display device having the pixel of FIG. 2.
Figure 4:
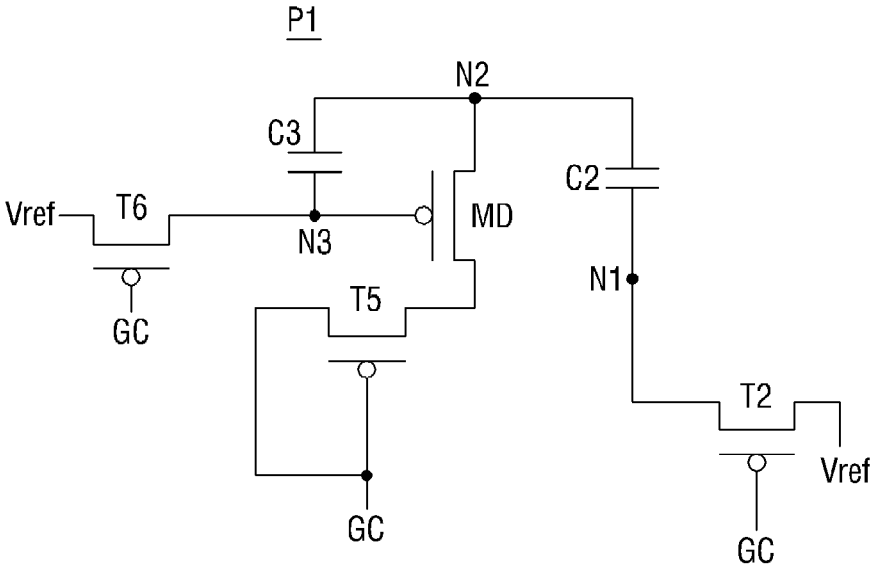
FIG. 4 is a circuit diagram of the pixel of FIG. 2 during a first period of a compensation period.
Figure 5:
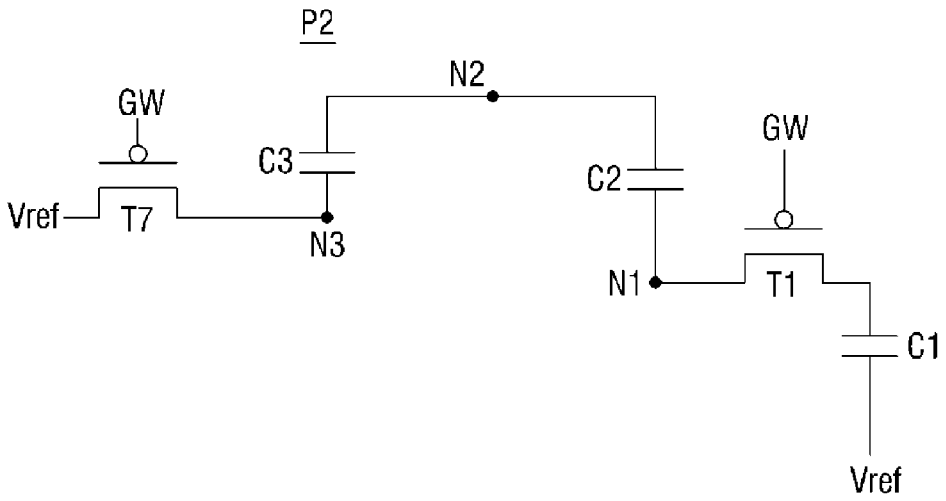
FIG. 5 is a circuit diagram of the pixel of FIG. 2 during a second period of the compensation period.
Figure 6:
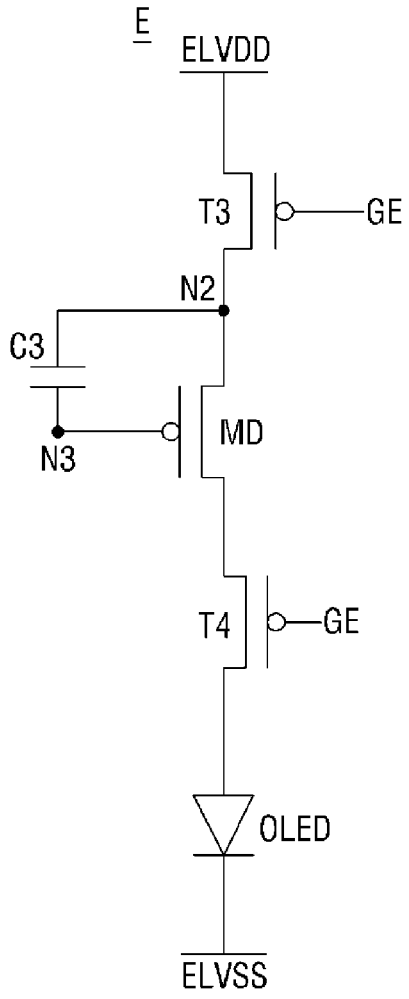
FIG. 6 is a circuit diagram of the pixel of FIG. 2 during an emission period.

FIG. 3 is a timing diagram illustrating a method of driving an organic light-emitting display device having the pixel 10 of FIG. 2. FIG. 4 is a circuit diagram of the pixel 10 of FIG. 2 during a first period P1 of a compensation period P. FIG. 5 is a circuit diagram of the pixel 10 of FIG. 2 during a second period P2 of the compensation period P. FIG. 6 is a circuit diagram of the pixel 10 of FIG. 2 during an emission period E.

Even though not specifically illustrated, during each frame, the voltage provided by the first power source ELVDD may maintain its high level, and the voltage provided by the second power source ELVSS may maintain its low level.

The frame is a period for displaying an image on the display panel 110 and may include a compensation period P and an emission period E. The compensation period P may include a first period P1 that is a period for initializing the driving voltage of the pixel 10, and a second period P2 that is a period for compensating for the threshold voltage Vth of the driving transistor MD. The emission period E may be a period during which data is written to the pixel 10 (for driving the pixel 10 during the next frame) and the pixel 10 emits light corresponding to the data written to the pixel 10 during the previous frame.

During the first period P1 of the compensation period P, the power supply 150 may provide a low-level first control signal GC and high-level second and third control signals GW and GE to the pixel 10. During the second period P2 of the compensation period P, the power supply 150 may provide a low-level second control signal GW and high-level first and third control signals GC and GE to the pixel 10. During the emission period E, the power supply 150 may provide a low-level third control signal GE and high-level first and second control signals GC and GW to the pixel 10.

In response to a low-level scan signal being applied to the switching transistor MS of the pixel 10, the switching transistor MS may be turned on. In response to the low-level scan signal, the pixel 10 may charge the first capacitor C1 with the j-th data voltage Vdata provided thereto via the j-th data line Dj. The j-th data voltage Vdata that the first capacitor C1 is charged with may be used during the emission period E of a subsequent frame.

FIGS. 3 to 6 illustrate circuit diagrams of examples of the pixel 10 to which data corresponding to a current frame is written during the emission period E, and which emits light according to data written thereto during a previous frame. The compensation period P may be, for example, a period during each frame, or a period activated during a standby period for turning on or off the pixel 10, but the present invention is not limited thereto. In other embodiments, the compensation period P may appear at regular intervals of time or may be activated according to a user setting.

Referring to FIGS. 3 and 4, during the first period P1 of the compensation period P, which is an initialization period, the reference voltage Vref that is provided by the reference voltage source Vref may be applied to the first node N1 and the gate electrode of the driving transistor MD. More specifically, the low-level first control signal GC may be applied to the gate electrodes of the second, fifth, and sixth transistors T2, T5, and T6, and the high-level second and third control signals GW and GE along with the high-level i-th scan signal may be applied to the gate electrodes of the other transistors (other than the driving transistor MD) of the pixel 10.

Accordingly, the second, fifth, and sixth transistors T2, T5, and T6 may be turned on by the low-level first control signal GC, and the other transistors (other than the driving transistor MD) may be turned off, or remain turned off, by the high-level second and third control signals GW and GE along with the high-level i-th scan signal. The reference voltage Vref, which is provided by the reference voltage source Vref via the turned-on second transistor T2, may be applied to the first node N1. The sum of the reference voltage Vref and the threshold voltage Vth of the driving transistor MD may be applied to the second node N2 according to the voltage applied to the first node N1 and the voltage applied to the second capacitor C2. The reference voltage Vref, which is provided by the reference voltage source Vref via the turned-on sixth transistor T6, may be applied to the third node N3.

The voltages applied to the first through third nodes N1 through N3 during the first period P1 of the compensation period P may be represented by Equation (1):

$$N1=V\text{ref};$$

$$N2=V\text{ref}+Vth;\text{ and}$$

$$N3=V\text{ref} \quad (1).$$

Thereafter, during the second period P2 of the compensation period P, a voltage corresponding to the j-th data voltage Vdata that the first capacitor C1 is charged with may be applied to the first electrode of the driving transistor MD by a switching operation. More specifically, referring to FIGS. 3 and 5, during the second period P2 of the compensation period P, which is for compensating for the threshold voltage Vth, the low-level second control signal GW may be applied to the gate electrodes of the first and seventh transistors T1 and T7, and the high-level first and third control signals GC and GE along with the high-level i-th scan signal may be applied to the other transistors (other than the driving transistor MD) of the pixel 10.

Accordingly, the first and seventh transistors T1 and T7 may be turned on by the low-level second control signal GW, and the other transistors (other than the driving transistor MD) may be turned off, or remain turned off, by the high-level first and third control signals GC and GE along with the high-level i-th scan signal. Due to capacitor sharing, which occurs in response to the first transistor T1 being turned on, the data voltage stored in the first capacitor C1, i.e., a second data voltage Vdata', may be applied to the first node N1. Due to a coupling that may occur because of a voltage variation caused by the application of the second data voltage Vdata' to the first node N1, a third data voltage Vdata", which corresponds to the ratio of the capacitances of the second and third capacitors C2 and C3, may be applied to the second node N2.

The reference voltage Vref, which is provided by the reference voltage source Vref via the turned-on seventh transistor T7, may be applied to the third node N3. Accordingly, the voltages applied to the first through third nodes N1 through N3 during the second period P2 of the compensation period P may be represented by Equation (2):

$$N1=V\text{ref}+V\text{data}';$$

$$N2=V\text{ref}+Vth+V\text{data}'';\text{ and}$$

$$N3=V\text{ref} \quad (2).$$

Thereafter, during the emission period E, a voltage corresponding to the j-th data voltage Vdata may be applied to the gate electrode of the driving transistor MD by connecting a path between the first power source ELVDD and the second power source ELVSS. More specifically, referring to FIGS. 3 and 6, during the emission period E, the low-level third control signal GE may be applied to the gate electrodes of the third and fourth transistors T3 and T4. Thereafter, a low-level i-th scan signal may be applied to the switching transistor MS, and the high-level first and second control signals GC and GW may be applied to the other transistors (other than the driving transistor MD).

Accordingly, the third and fourth transistors T3 and T4 may be turned on by the low-level third control signal GE, the switching transistor MS may be turned on by the low-level i-th scan signal while the third and fourth transistors T3 and T4 are turned on, and the other transistors (other than the driving transistor MD) may be turned off, or remain turned off, by the high-level first and second control signals GC and GW. In response to the third and fourth transistors T3 and T4 being turned on, a driving voltage (first power source voltage) ELVDD from the first power source ELVDD may be applied to the second node N2, and a first data voltage Vdata1, which is determined based on the threshold voltage Vth of the driving transistor MD, the reference voltage Vref, and the third data voltage Vdata" that are all applied to the second node N2, may be applied to the third node N3.

The voltages applied to the second and third nodes N2 and N3 during the emission period E may be represented by Equation (3):

$$N2=ELVDD;\text{ and}$$

$$N3=V\text{ref}+ELVDD-(V\text{ref}+Vth+V\text{data}'')=ELVDD-Vth-V\text{data}'' \quad (3).$$

In response to the driving voltage ELVDD and the first data voltage Vdata1 being applied to the second and third nodes N2 and N3, respectively, a driving current I flowing through the OLED may be represented by Equation (4):

$$Vsg(N2-N1)=V\text{data}''+Vth;\text{ and}$$

$$I_d=K_p(Vsg-|Vth|)^2=Kp(V\text{data}'')^2 \quad (4)$$

where $I_d$ denotes a driving current flowing from the first power source ELVDD to the second power source ELVSS, Kp denotes a constant determined by mobility, parasitic capacitance, and the size of a channel, and Vsg denotes a source-gate voltage of the driving transistor MD. The OLED may emit light with a luminance corresponding to the driving current $I_d$. Referring to Equation (4), since the threshold voltage Vth of the driving transistor MD is erased, the pixel 10 may emit light with the luminance corresponding to the driving current $I_d$, which is not much affected by deviations in the threshold voltage Vth of the driving transistor MD.

That is, as indicated in Equation (4), the driving current $I_d$ may be determined by the third data voltage Vdata", which may be determined from the j-th data voltage Vdata and the reference voltage Vref, which in turn are both controllable by a user, regardless of the threshold voltage Vth of the driving transistor MD and the driving voltage ELVDD applied to the first electrode of the driving transistor MD. Accordingly, even when the threshold voltage Vth of the driving transistor MD and the driving voltage ELVDD vary from one pixel to another pixel, luminance irregularities between pixels may be addressed by using the j-th data voltage Vdata and the reference voltage Vref, which are controllable by a user.

The reference voltage Vref may be set to any value, such as a fixed voltage value. For example, in some embodiments, the reference voltage Vref is set to a value between the high-value voltage (off) and the low-value voltage (on) of the gate electrodes of the transistors of the pixel 10, or between the first power source voltage ELVDD and the second power source voltage ELVSS. In some embodiments, the reference voltage Vref is set between the high-value voltage and the low-value voltage, but is closer to the high-value voltage than to the low-value voltage (for example, 70% of the way between the low-value voltage and the high-value voltage).

Thereafter, the low-level i-th scan signal may be applied to the switching transistor MS, and as a result, the switching transistor MS may be turned on. The switching transistor MS may charge the first capacitor C1 with the j-th data voltage Vdata, which is provided via the j-th data line Dj according to the i-th scan signal. The j-th data voltage Vdata that the first capacitor C1 is charged with may be used during the emission period E of a subsequent frame.

Figure 7:
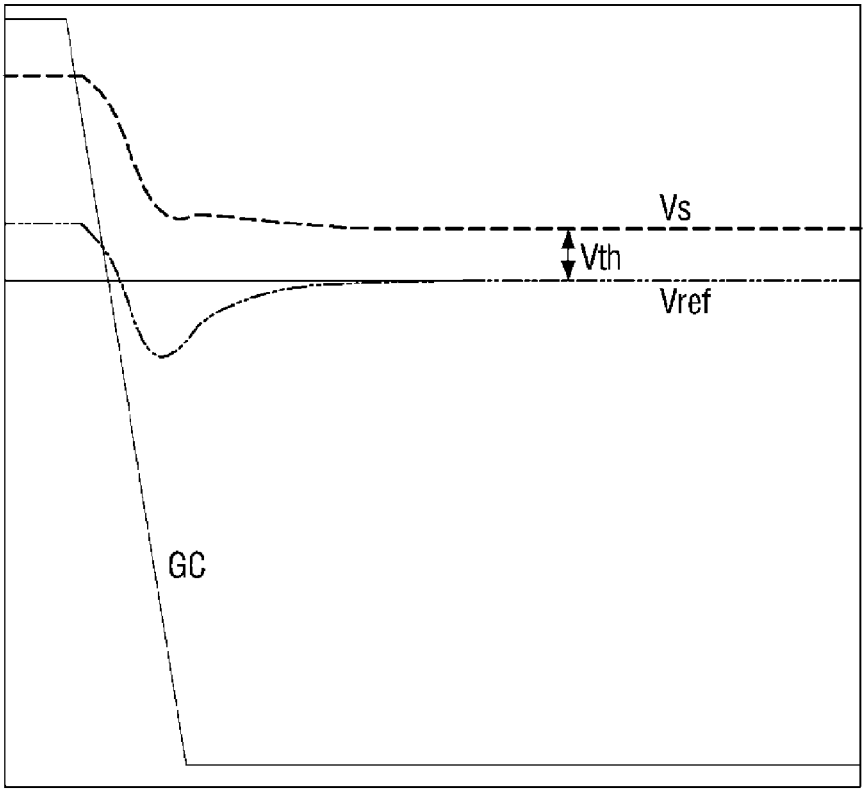
FIG. 7 is a simulation graph illustrating a voltage applied to a second node of a pixel of the organic light-emitting display device of FIG. 1 during the first period of the compensation period.

FIG. 7 is a simulation graph illustrating a voltage applied to a second node N2 of a pixel PX the organic light-emitting display device of FIG. 1 during the first period P1 of the compensation period P. Referring to FIG. 7, a voltage Vs may be defined as being the voltage applied to the second node N2 during a first period P1 of the compensation period P when the first control signal GC has a low level. It is apparent from FIGS. 4 and 7 that the voltage Vs, which is applied to the second node N2, corresponds to the sum of the reference voltage Vref and the threshold voltage Vth of the driving transistor MD.

Figure 8:
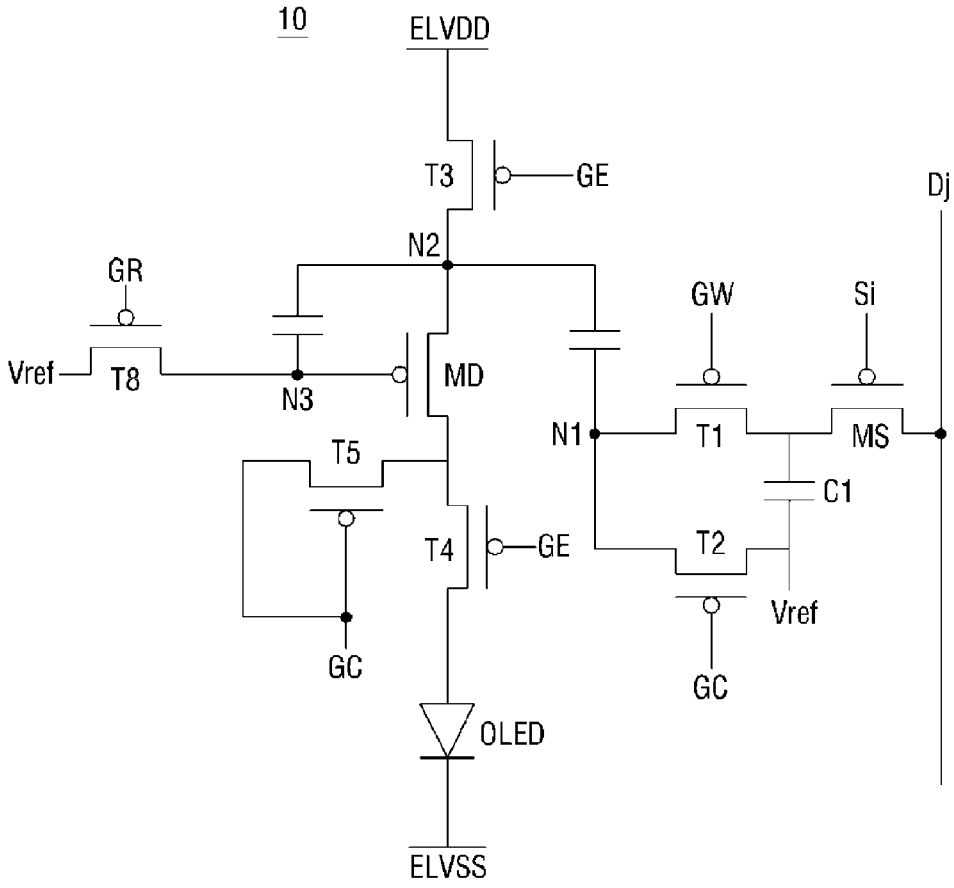
FIG. 8 is a circuit diagram of another example of a pixel of the organic light-emitting display device of FIG. 1.
Figure 9:
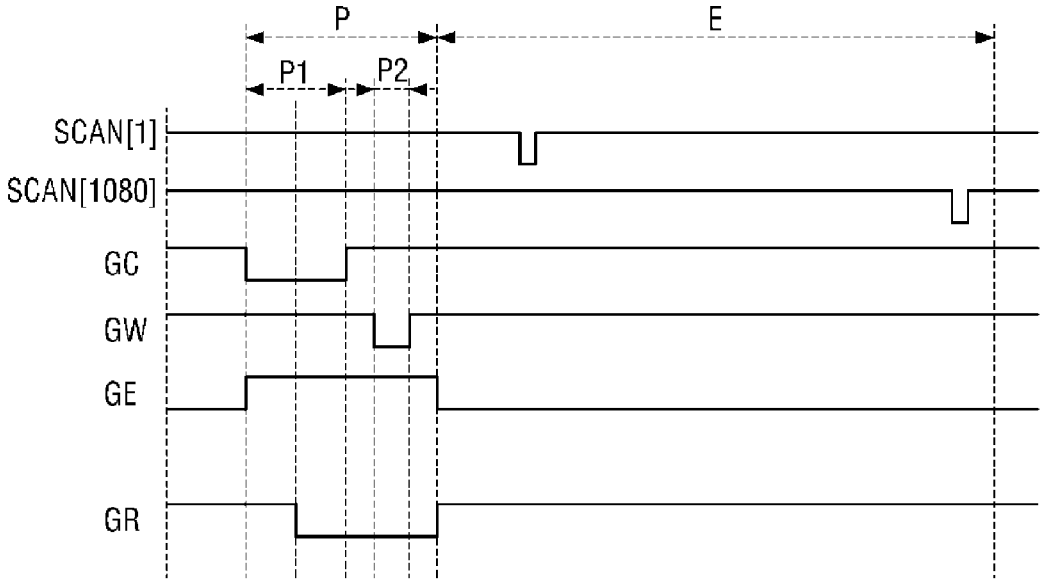
FIG. 9 is a timing diagram illustrating a method of driving an organic light-emitting display device having the pixel of FIG. 8.

FIG. 8 is a circuit diagram of another example of the pixel 10 of the organic light-emitting display device of FIG. 1. FIG. 9 is a timing diagram illustrating a method of driving an organic light-emitting display device having the pixel 10 of FIG. 8. Descriptions of the elements of the pixel 10 of FIGS. 8 and 9 that already have been described with reference to FIGS. 2 to 6 will not be repeated.

Referring to FIGS. 8 and 9, the pixel 10 may include a switching unit having an eighth transistor T8. The eighth transistor T8 may include a gate electrode to which a fourth control signal GR is applied, a first electrode that is connected to a reference voltage source Vref, and a second electrode that is connected to a third node N3. The pixel 10 may be turned on or off by the fourth control signal GR.

More specifically, as illustrated in FIG. 9, the eighth transistor T8 may be turned on a set or predetermined amount of time after the beginning of the first period P1 of the compensation period P, and may be turned off when the compensation period P ends. The third transistor T8 may apply a reference voltage Vref provided by the reference voltage source Vref to the third node N3 through a switching operation that has been described above with reference to FIGS. 2 to 6. In the pixel 10 of the embodiment of FIGS. 2 to 6, a coupling may occur due to the sixth and seventh transistors T6 and T7 being turned on or off, as described above with reference to FIGS. 2, 4, and 5. On the other hand, in the pixel 10 of the embodiment of FIGS. 8 and 9, the occurrence of a coupling may be reduced or minimized by applying the reference voltage Vref to the third node N3 via the eighth transistor T8, which is turned on or off according to the fourth control signal GR.

Figure 10:
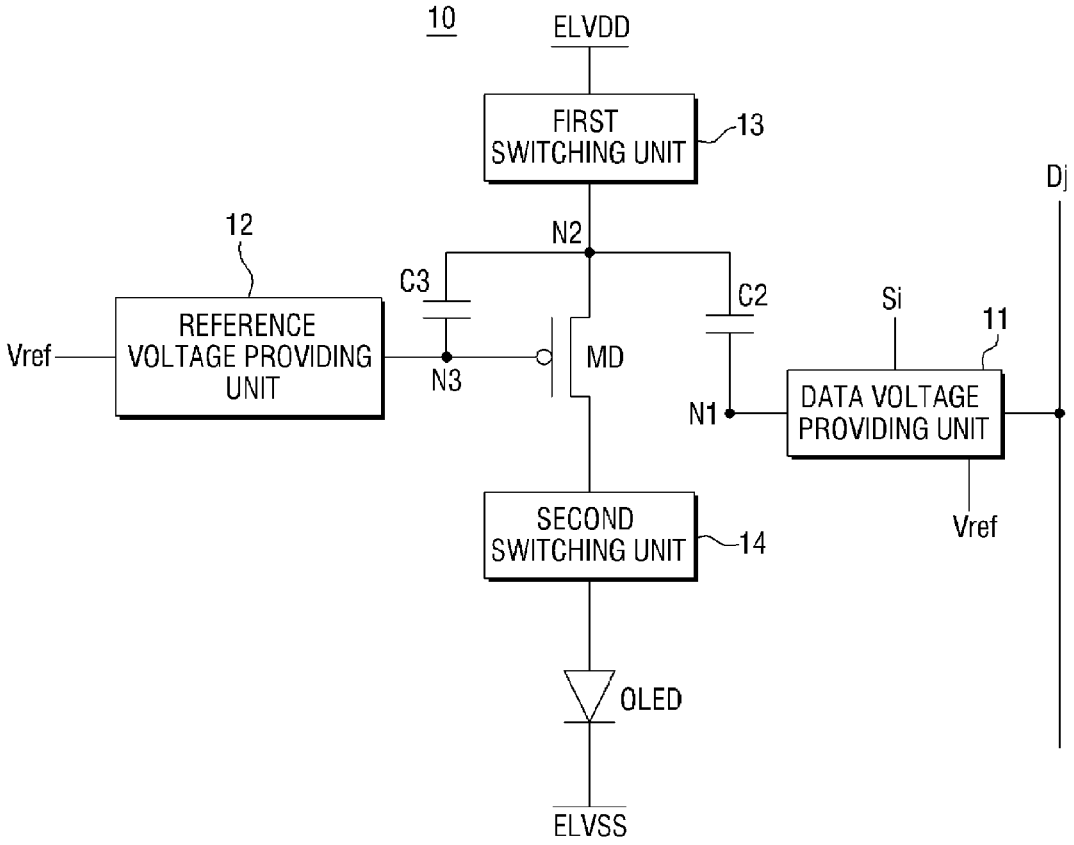
FIG. 10 is a circuit diagram of yet another example of a pixel of the organic light-emitting display device of FIG. 1.

FIG. 10 is a circuit diagram of yet another example of the pixel 10 of the organic light-emitting display device of FIG. 1.

Referring to FIGS. 2 to 10, the pixel 10 may include a data voltage providing unit 11, a reference voltage providing unit 12, a first switching unit 13, a second switching unit 14, a driving transistor MD, and an OLED. The data voltage providing unit 11 may include a first capacitor C1 that is connected to a reference voltage source Vref, and a switching transistor MS that has a first electrode connected to the j-th data line Dj, a second electrode connected to the first capacitor C1, and a gate electrode connected to the i-th scan line Si. The data voltage providing unit 11 may include a first transistor T1 that has a first electrode connected to the second electrode of the switching transistor MS and a second electrode connected to a first node N1, and a second transistor T2 that has a first electrode connected to a second terminal of the first capacitor C1 and a second electrode connected to the first node N1.

The data voltage providing unit 11 may apply a reference voltage Vref to the first node N1 during a first period P1 of a compensation period P when the first transistor T1 is turned off and the second transistor T2 is turned on, and may apply a second data voltage Vdata' to the first node N1 during a second period P2 of the compensation period P when the first transistor T1 is turned on and the second transistor T2 is turned off.

The first switching unit 13 may block the path between a first power source ELVDD and a second node N2 during the first or second period P1 or P2 of the compensation period P, and may connect the path between the first power source ELVDD and the second N2 during an emission period E that follows the second period P2 of the compensation period P. The second switching unit 14 may block the path between the second electrode of the driving transistor MD and the OLED during the first or second period P1 or P2 of the compensation period P, and may connect the path between the second electrode of the driving transistor MD and the OLED during the emission period E.

In an embodiment, the first switching unit 13 may include a third transistor T3 that has a gate electrode provided with the third control signal GE, a first electrode connected to the first power source ELVDD, and a second electrode connected to the second node N2. The second switching unit 14 may include a fourth transistor T4 that has a gate electrode provided with the third control signal GE, a first electrode connected to the second electrode of the driving transistor MD, and a second electrode connected to the OLED. The second switching unit 14 may also include a fifth transistor T5 that has a gate electrode provided with the first control signal GC, a first electrode connected to the second electrode of the driving transistor MD, and a second electrode connected to the gate electrode of the fifth transistor T5.

In an embodiment, the reference voltage providing unit 12 may include sixth and seventh transistors T6 and T7 that provide a two-way path (for example, two separate paths) between the reference voltage source Vref and a third node. N3. The reference voltage providing unit 12 may apply the reference voltage Vref, which is provided by the reference voltage source Vref, to the third node N3 through a switching operation performed by the sixth and seventh transistors T6 and T7.

In another embodiment, the reference voltage providing unit 12 may include an eighth transistor T8 (for example, instead of the sixth and seventh transistors T6 and T7) that has a first electrode connected to the reference voltage source Vref, a second electrode connected to the third node N3 and a gate electrode provided with the fourth control signal GR. The eighth transistor T8 may be turned on a set or predetermined amount of time after the beginning of the first period P1 of the compensation period P, and may be turned off when the compensation period P ends. The third transistor T8 may apply the reference voltage Vref, which is provided by the reference voltage source Vref, to the third node N3 through a switching operation that has been described above.

While the present invention has been particularly shown and described with reference to embodiments thereof, it will be understood by those of ordinary skill in the art that various changes may be made therein without departing from the spirit and scope of the invention as defined by the following claims, and equivalents thereof. The embodiments should be considered in a descriptive sense only and not for purposes of limitation.

What is claimed is:

1. An organic light-emitting display device comprising:
a data driver configured to provide a data signal to a data line;
a scan driver configured to provide a scan signal to a scan line; and
a display panel comprising at least one pixel at a crossing region of the data line and the scan line, the at least one pixel comprising:
a switching transistor comprising a gate electrode connected to the scan line and a first electrode connected to the data line;
a first capacitor comprising a first terminal connected to a second electrode of the switching transistor and a second terminal connected to a reference voltage source;
a second capacitor comprising a first terminal connected to the first electrode of the switching transistor via a first node and a second terminal connected to a second node;
a driving transistor comprising a first electrode directly connected to the second node, and connected to a first power source via the second node, a second electrode connected to an organic light-emitting diode (OLED), and a gate electrode connected to the reference voltage source via a third node; and
a third capacitor comprising a first terminal connected to the second node and a second terminal connected to the third node.

2. The organic light-emitting display device of claim 1, wherein the at least one pixel further comprises:
a first transistor comprising a first electrode connected to the second electrode of the switching transistor and a second electrode connected to the first node;
a second transistor comprising a first electrode connected to the reference voltage source and a second electrode connected to the first node;
a switching unit connected between the reference voltage source and the third node;
a third transistor comprising a first electrode connected to the first power source and a second electrode connected to the second node;
a fourth transistor comprising a first electrode connected to the second electrode of the driving transistor and a second electrode connected to the OLED; and
a fifth transistor comprising a first electrode connected to the first electrode of the fourth transistor and a second electrode connected to a gate electrode of the fifth transistor.

3. The organic light-emitting display device of claim 2, wherein the switching unit comprises sixth and seventh transistors, each constituting a separate path between the reference voltage source and the third node.

4. The organic light-emitting display device of claim 3, wherein the second, fifth and sixth transistors are configured to turn on during a first period of a compensation period, the first and seventh transistors are configured to turn on during a second period of the compensation period, which follows the first period, and the third and fourth transistors are configured to turn on during an emission period, which follows the second period.

5. The organic light-emitting display device of claim 2, wherein the switching unit comprises an eighth transistor comprising a first electrode connected to the reference voltage source and a second electrode connected to the third node.

6. The organic light-emitting display device of claim 1, wherein the driving transistor is configured to control a driving current flowing through the OLED by using a data voltage that depends on a voltage charged in each of the first through third capacitors as well as a voltage provided by the first power source via the second node.

7. An organic light-emitting display device comprising:
a data driver configured to provide a data signal to a data line;
a scan driver configured to provide a scan signal to a scan line; and
a display panel comprising at least one pixel at a crossing region of the data line and the scan line, the at least one pixel comprising:
a data voltage providing unit configured to charge a first capacitor with a data voltage provided via the data line and apply the data voltage that the first capacitor is charged with to a first node via a switching operation;
a second capacitor comprising a first terminal connected to the first node and a second terminal connected to a second node;
a driving transistor comprising a first electrode directly connected to the second node, and configured to control a driving current flowing through an organic light-emitting diode (OLED) according to a voltage applied to the second node and a voltage applied to a third node that is connected to a gate electrode of the driving transistor;
a reference voltage providing unit configured to apply a reference voltage to the third node;
a third capacitor comprising a first terminal connected to the second node and a second terminal connected to the third node, and configured to be charged with the reference voltage;
a first switching unit configured to connect or block a path between a first power source and the second node; and
a second switching unit configured to connect or block a path between a second electrode of the driving transistor and the OLED.

8. The organic light-emitting display device of claim 7, wherein the data voltage providing unit comprises:
a switching transistor comprising a first electrode connected to the data line and a gate electrode connected to the scan line;
a first transistor comprising a first electrode connected to a second electrode of the switching transistor and a second electrode connected to the first node; and
a second transistor comprising a first electrode connected to a second terminal of the first capacitor and a second electrode connected to the first node.

9. The organic light-emitting display device of claim 7, wherein the first switching unit comprises a third transistor comprising a first electrode connected to the first power source and a second electrode connected to the second node.

10. The organic light-emitting display device of claim 7, wherein the second switching unit comprises:
a fourth transistor comprising a first electrode connected to the second electrode of the driving transistor and a second electrode connected to the OLED; and a fifth transistor comprising a first electrode connected to the first electrode of the fourth transistor and a second electrode connected to a gate electrode of the fifth transistor.

11. The organic light-emitting display device Of claim 7, wherein the reference voltage providing unit comprises sixth and seventh transistors, each constituting a separate path between a source of the reference voltage and the third node.

12. The organic light-emitting display device of claim 7, wherein the reference voltage providing unit comprises an eighth transistor comprising a first electrode connected to a source of the reference voltage and a second electrode connected to the third node.

13. The organic light-emitting display device of claim 7, wherein the driving transistor is configured to control the driving current flowing through the OLED by using a data voltage that depends on a voltage charged in each of the first through third capacitors as well as a voltage provided by the first power source via the second node.

14. The organic light-emitting display device of claim 7, wherein the data voltage providing unit is configured to apply the reference voltage to the first node during a first period of a compensation period and apply the data voltage to the first node during a second period of the compensation period, which follows the first period, and the reference voltage providing unit is configured to apply the reference voltage to the third node during the first and second periods.

15. The organic light-emitting display device of claim 14, wherein the first switching unit is configured to block a path between the first power source and the second node during the first and second periods and to connect the path between the first power source and the second node during an emission period, which follows the second period, and the second switching unit is configured to block a path between the second electrode of the driving transistor and the OLED during the first and second periods and to connect the path between the second electrode of the driving transistor and the OLED during the emission period.

16. A method of driving an organic light-emitting display device comprising at least one pixel, the at least one pixel comprising a driving transistor comprising a first electrode directly connected to a second node, and connected between a first power source and a second power source and configured to control a driving current flowing through an OLED, a switching transistor connected to a data line, and a first capacitor connected between the switching transistor and a reference voltage source, the method comprising:

applying a reference voltage provided by the reference voltage source to a first node and a gate electrode of the driving transistor during a first period of a compensation period;

applying a data voltage that the first capacitor is charged with to a first electrode of the driving transistor through a switching operation during a second period of the compensation period that follows the first period; and applying the data voltage to the gate electrode of the driving transistor by connecting a path between the first power source and the second power source during an emission period.

17. The method of claim 16, wherein the at least one pixel comprises:

a first switching unit configured to connect or block a path between the first power source and the second node; and a second switching unit configured to connect or block a path between a second electrode of the driving transistor and the OLED.

18. The method of claim 17, wherein during the first and second periods, the first switching unit is configured to block the path between the first power source and the second node, and the second switching unit is configured to block the path between the second electrode of the driving transistor and the OLED, and during the emission period, the first switching unit is configured to connect the path between the first power source and the second node, and the second switching unit is configured to connect the path between the second electrode of the driving transistor and the OLED.

19. The method of claim 16, wherein the at least one pixel further comprises:

a second capacitor comprising a first terminal connected to the first node and a second terminal connected to the first electrode of the driving transistor; and a third capacitor comprising a first terminal connected to the first electrode of the driving transistor and a second terminal connected to the gate electrode of the driving transistor.

20. The method of claim 19, wherein the data voltage depends on a voltage charged in each of the first through third capacitors as well as a driving voltage provided by the first power source, and the driving transistor is configured to control the driving current flowing through the OLED according to the data voltage.

* * * * *